US007934812B2

(12) United States Patent
Koseki

(10) Patent No.: US 7,934,812 B2
(45) Date of Patent: May 3, 2011

(54) INKJET HEAD CHIP, DRIVING METHOD FOR INKJET HEAD CHIP, INKJET HEAD, AND INKJET RECORDING APPARATUS

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 163 days.

(21) Appl. No.: 12/319,377

(22) Filed: Jan. 7, 2009

(65) Prior Publication Data

US 2009/0185010 A1 Jul. 23, 2009

(30) Foreign Application Priority Data

Jan. 11, 2008 (JP) ..... 2008-003944

(51) Int. Cl.
*B41J 2/045* (2006.01)

(52) U.S. Cl. ..... 347/68

(58) Field of Classification Search ..... 347/68, 347/69–72, 311, 324, 358, 360; 400/124.14, 400/124.16

See application file for complete search history.

(56) References Cited

U.S. PATENT DOCUMENTS

| | | | | |
|---|---|---|---|---|
| 5,984,447 | A | 11/1999 | Ohashi | 347/9 |
| 2001/0030673 | A1 | 10/2001 | Shigemura | 347/68 |

FOREIGN PATENT DOCUMENTS

| | | |
|---|---|---|
| EP | 0968823 | 1/2000 |
| EP | 1426185 | 6/2004 |
| EP | 1493578 | 1/2005 |
| EP | 1495869 | 1/2005 |
| WO | 01 36202 | 5/2001 |

*Primary Examiner* — K. Feggins
(74) *Attorney, Agent, or Firm* — Adams & Wilks

(57) ABSTRACT

An inkjet head chip has an ink chamber containing ink, channels separated by piezoelectric elements and disposed parallel to each other along a width direction of the inkjet head chip, and a nozzle hole for discharging an ink droplet. The channels include a discharge channel disposed in a middle portion of the parallely disposed channels and communicating with the ink chamber and nozzle hole, dummy channels disposed outside of the discharge channel at respective ends thereof, and non-discharge channels toward the recording medium and supply of the ink from the ink chamber to the dummy channels is interrupted. The discharge of an ink droplet from the non-discharge channels toward the recording medium and the supply of ink from the ink chamber to the non-discharge channels are interrupted. The inkjet head chip is configured such that voltages are substantially simultaneously applied to one of the plurality of piezoelectric elements which is adjacent to the discharge channel and to one of the plurality of piezoelectric elements which is disposed between the dummy and non-discharge channels.

17 Claims, 5 Drawing Sheets

INKJET HEAD CHIP, DRIVING METHOD FOR INKJET HEAD CHIP, INKJET HEAD, AND INKJET RECORDING APPARATUS

BACKGROUND OF THE INVENTION

1. Field of the Invention

The present invention relates to a piezoelectric type inkjet head chip for deforming a piezoelectric element through voltage application and boosting a channel internal pressure to discharge an ink droplet through a nozzle hole, a driving method for an inkjet head chip, an inkjet head, and an inkjet recording apparatus.

2. Description of the Related Art

As to the above-mentioned piezoelectric type inkjet head chip, there has been conventionally known a structure including an ink chamber for containing ink, a plurality of piezoelectric elements deformable through voltage application, a plurality of channels partitioned with the piezoelectric elements and formed parallel to each other, and nozzle holes communicating with the channels for discharging an ink droplet toward a recording medium.

Specifically, the inkjet head chip includes an ink chamber plate including the ink chamber formed on one surface thereof, an actuator plate including the plurality of channels formed on one surface thereof, and a nozzle plate including a plurality of the nozzle holes formed in a row, in which another surface of the ink chamber plate and the one surface of the actuator plate are bonded to each other so that the ink chamber plate overlaps the actuator plate, and the nozzle plate is bonded to one end of the actuator plate in a channel longitudinal direction thereof. Ink introduction holes are formed in the ink chamber plate, and the ink chamber and the channels are communicated with each other through the ink introduction holes, whereby the ink contained in the ink chamber is supplied to the channels. According to the inkjet head chip with the structure as described above, a voltage is applied to the piezoelectric element for deformation, and a volume of the channel partitioned with the deformed piezoelectric element is contracted to boost a channel internal pressure, to thereby discharge the ink contained in the channel. Accordingly, the ink droplet can be sprayed onto the recording medium.

The above-mentioned inkjet head chip is classified into a shared wall type inkjet head chip in which discharge channels (channels communicating with the nozzle holes) are successively disposed side by side and an independent channel type inkjet head chip in which discharge nozzles and non-discharge nozzles (channels not communicating with the nozzle holes) are alternately disposed side by side.

In the above-mentioned inkjet head chip, it is desired that discharge speeds of the respective nozzle holes disposed in a row be made uniform for improving image quality of a printed matter by an inkjet printer.

For this purpose, there has been conventionally proposed a technology of optimizing a driving waveform as described in JP 2006-224545 A. This technology is applicable to the shared wall type inkjet head chip. In this technology, when a discharge channel which discharges ink sporadically or intermittently does not discharge ink, a pulse which is so short that ink is not discharged is applied in response to a restoration timing of the discharge channel which has discharged ink. This technology solves a problem that an ink discharge speed of a nozzle hole of a discharge channel which discharges ink sporadically or intermittently is slower than an ink discharge speed of a nozzle hole of a discharge channel which discharges ink successively. Accordingly, ink discharge speeds of the respective nozzle holes can be made uniform.

However, in the above-mentioned conventional technology, a difference in ink discharge speed of the nozzle hole is generated between discharge channels disposed in a middle portion of the discharge channels in a channel parallel direction and discharge channels disposed in both end portions thereof in the channel parallel direction, which causes a problem that ink discharge speeds of the respective nozzle holes cannot be made sufficiently uniform. More specifically, in the shared wall type inkjet head chip, discharge speeds of the nozzle holes disposed in both end portions of the inkjet head chip are slower compared with the nozzle holes disposed in a middle portion thereof, and in the independent channel type inkjet head chip, discharge speeds of the nozzle holes disposed in both end portions of the inkjet head chip are faster compared with the nozzle holes disposed in a middle portion thereof. As to the cause of the difference in ink discharge speed as described above, it is conceivable that an electrical condition is different between the discharge channels disposed in the both end portions and the discharge channels disposed in the middle portion. In other words, a number of other discharge channels are formed on both sides of each of the discharge channels disposed in the middle portion, and thus an electric field applied to the other discharge channels affects the discharge channels disposed in the middle portion from the both sides thereof. On the other hand, a number of other discharge channels are formed only on one side of each thereof, and hence an electric field applied to the other discharge channels affects the discharge channels disposed in the both end portions only from the one side thereof.

SUMMARY OF THE INVENTION

The present invention has been made in view of the above-mentioned conventional problems, and therefore an object thereof is to provide an inkjet head chip, a driving method for an inkjet head chip, an inkjet head, and an inkjet head recording apparatus which reduces a difference in ink discharge speeds between the middle portion and the both end portions of the discharge channels in the channel parallel direction and are capable of making ink discharge speeds of the respective nozzle holes uniform.

An inkjet head chip according to the present invention includes: an ink chamber for containing ink; a plurality of piezoelectric elements deformable by applying a voltage; a plurality of channels partitioned with the plurality of piezoelectric elements and formed parallel to each other; and a nozzle hole for discharging an ink droplet toward a recording medium, in which: the plurality of channels include a discharge channel disposed in a middle portion of the plurality of channels in a channel parallel direction and a dummy channel disposed in each of both end portions of the plurality of channels in the channel parallel direction; the discharge channel communicates with the ink chamber via an ink introduction hole and with the nozzle hole; at least one of discharge of the ink droplet from the dummy channel toward the recording medium and supply of the ink from the ink chamber to the dummy channel is interrupted; and one of the plurality of piezoelectric elements which is adjacent to the discharge channel and one of the plurality of piezoelectric elements which is adjacent to the dummy channel are each applied with a voltage.

With the feature as described above, a voltage is applied to each of the piezoelectric element which is adjacent to the discharge channel and the piezoelectric element which is adjacent to the dummy channel to thereby deform both the piezoelectric elements. Accordingly, volume of the discharge channel is contracted and the ink within the discharge channel is discharged from the nozzle hole. At this time, of a plurality of the discharge channels, an electrical condition of the discharge channels in the both end portions thereof becomes similar to that of the discharge channels in the middle portion thereof. In other words, on both sides of a discharge channel in the middle portion, other discharge channels are formed, and the discharge channel is affected, from the both sides thereof, by an electric field applied to the other discharge channels. On the other hand, on one side of the discharge channel in each of the both end portions (center side in the channel parallel direction), another discharge channel is formed, and on another side thereof, a dummy channel is formed. The discharge channels in the both end portions are affected, from both sides thereof, by an electric field applied to other channels. Further, at least one of the discharge of the ink droplet from the dummy channel toward the recording medium and the supply of the ink from the ink chamber to the dummy channel is interrupted, and hence, even when the piezoelectric element which is adjacent to the dummy channel is applied with a voltage, the ink is not discharged from the dummy channel.

Further, in the inkjet head chip according to the present invention, the one of the plurality of piezoelectric elements which is adjacent to the dummy channel and the one of the plurality of piezoelectric elements which is adjacent to the discharge channel are preferably applied with a similar voltage.

With this structure, when a voltage is applied to each of the piezoelectric element which is adjacent to the discharge channel and the piezoelectric element which is adjacent to the dummy channel, the electrical condition of the discharge channels in the both end portions becomes similar to that of the discharge channel in the middle portion.

Further, in the inkjet head chip according to the present invention, of the plurality of channels, each of 1st to 5th channels from end channels in the channel parallel direction is preferably the dummy channel.

With this structure, the electrical condition of the discharge channels in the both end portions becomes similar to that of the discharge channels in the middle portion, and an increase in the number of the channels is suppressed at the same time.

Note that the above-mentioned "1 to 5" are integers, and specifically, "1, 2, . . . 5".

According to the present invention, there is provided a driving method for an inkjet head chip, the inkjet head chip including: an ink chamber for containing ink; a plurality of piezoelectric elements deformable by applying a voltage; a plurality of channels partitioned with the plurality of piezoelectric elements and formed parallel to each other; and a nozzle hole for discharging an ink droplet toward a recording medium, the plurality of channels including a discharge channel disposed in a middle portion of the plurality of channels in a channel parallel direction and a dummy channel disposed in each of both end portions of the plurality of channels in the channel parallel direction, the discharge channel communicating with the ink chamber via an ink introduction hole and with the nozzle hole, one of discharge of the ink droplet from the dummy channel toward the recording medium and supply of the ink from the ink chamber to the dummy channel being interrupted, the driving method including applying a voltage to one of the plurality of piezoelectric elements which is adjacent to the discharge channel and one of the plurality of piezoelectric elements which is adjacent to the dummy channel.

With the feature as described above, of a plurality of the discharge channels, on one side of the discharge channel in each of the both end portions thereof, another discharge channel is formed, and on another side thereof, a dummy channel is formed. Hence, an electrical condition of the discharge channels in the both end portions thereof becomes similar to that of the discharge channels in the middle portion thereof. Further, at least one of the discharge of the ink droplet from the dummy channel toward the recording medium and the supply of the ink from the ink chamber to the dummy channel is interrupted, and hence, even when the piezoelectric element which is adjacent to the dummy channel is applied with a voltage, the ink is not discharged from the dummy channel.

An inkjet head according to the present invention includes the inkjet head chip described above.

An inkjet recording apparatus according to the present invention includes: the above-mentioned inkjet head; ink supply means for supplying ink to an ink chamber of an inkjet head chip included in the inkjet head; and recording medium transport means for transporting a recording medium so as to pass through a position opposed to a nozzle hole of the inkjet head chip.

Owing to the above-mentioned features, an ink droplet is sprayed from the nozzle hole of the inkjet head chip onto the recording medium transported by the recording medium transport means. On this occasion, the nozzle holes disposed in the both end portions and the nozzle holes disposed in the middle portion are each in the electrical conditions approximate to each other, whereby discharge speeds of ink droplets of the plurality of nozzle holes are made uniform.

With the inkjet head chip, the driving method for an inkjet head chip, the inkjet head, and the inkjet recording apparatus according to the present invention, of the plurality of discharge channels, the electrical condition of the discharge channels in the both end portions of the plurality of discharge channels becomes similar to the electrical condition of the discharge channels in the middle portion of the plurality of discharge channels, whereby the difference in ink discharge speed is hardly caused between the middle portion and the both end portions thereof in the channel parallel direction, and the uniform ink discharge speed from each nozzle hole can be achieved. Accordingly, the image quality of the printing can be improved.

DETAILED DESCRIPTION OF THE PREFERRED EMBODIMENT

Hereinafter, a description is given of an embodiment of an inkjet head chip, a driving method for an inkjet head chip, an inkjet head, and an inkjet recording apparatus according to the present invention with reference to the drawings.

Figure 1:
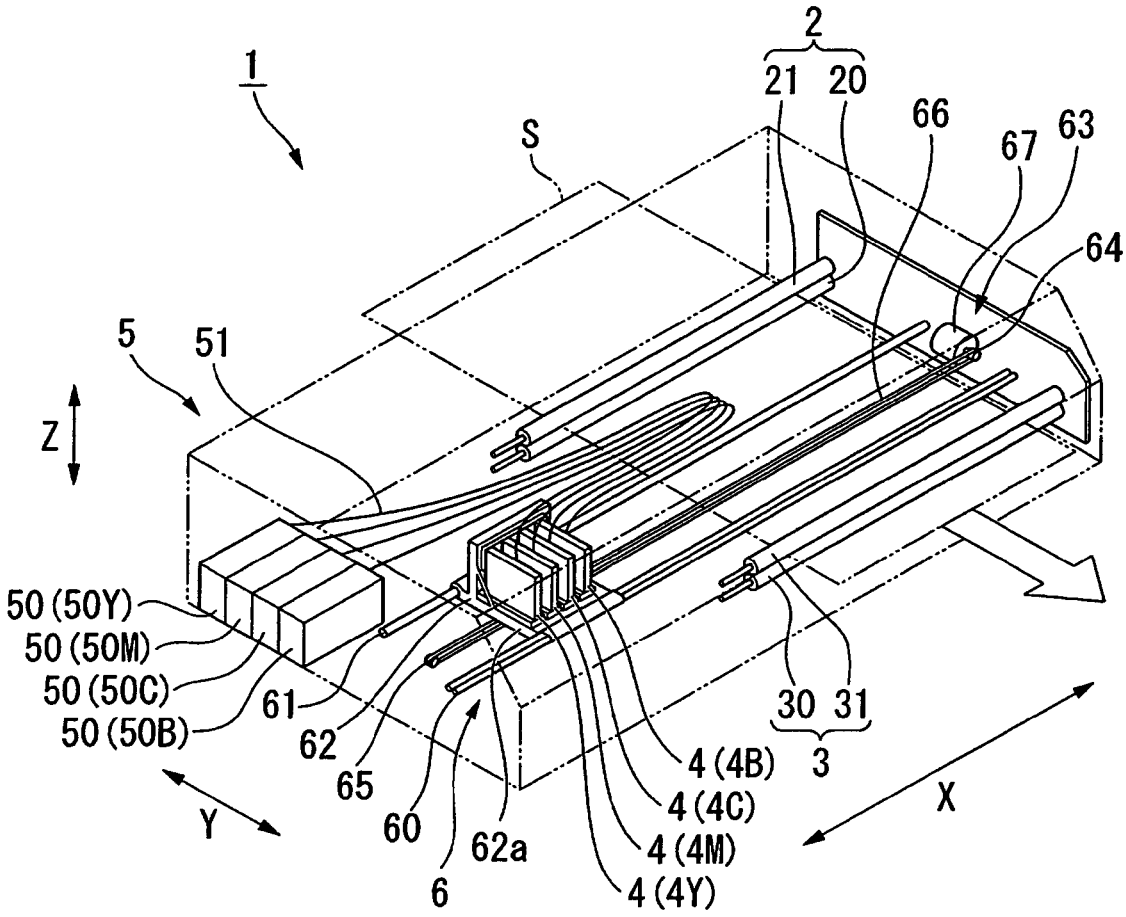
FIG. 1 is a perspective view for illustrating an inkjet recording apparatus according to an embodiment of the present invention.
Figure 2:
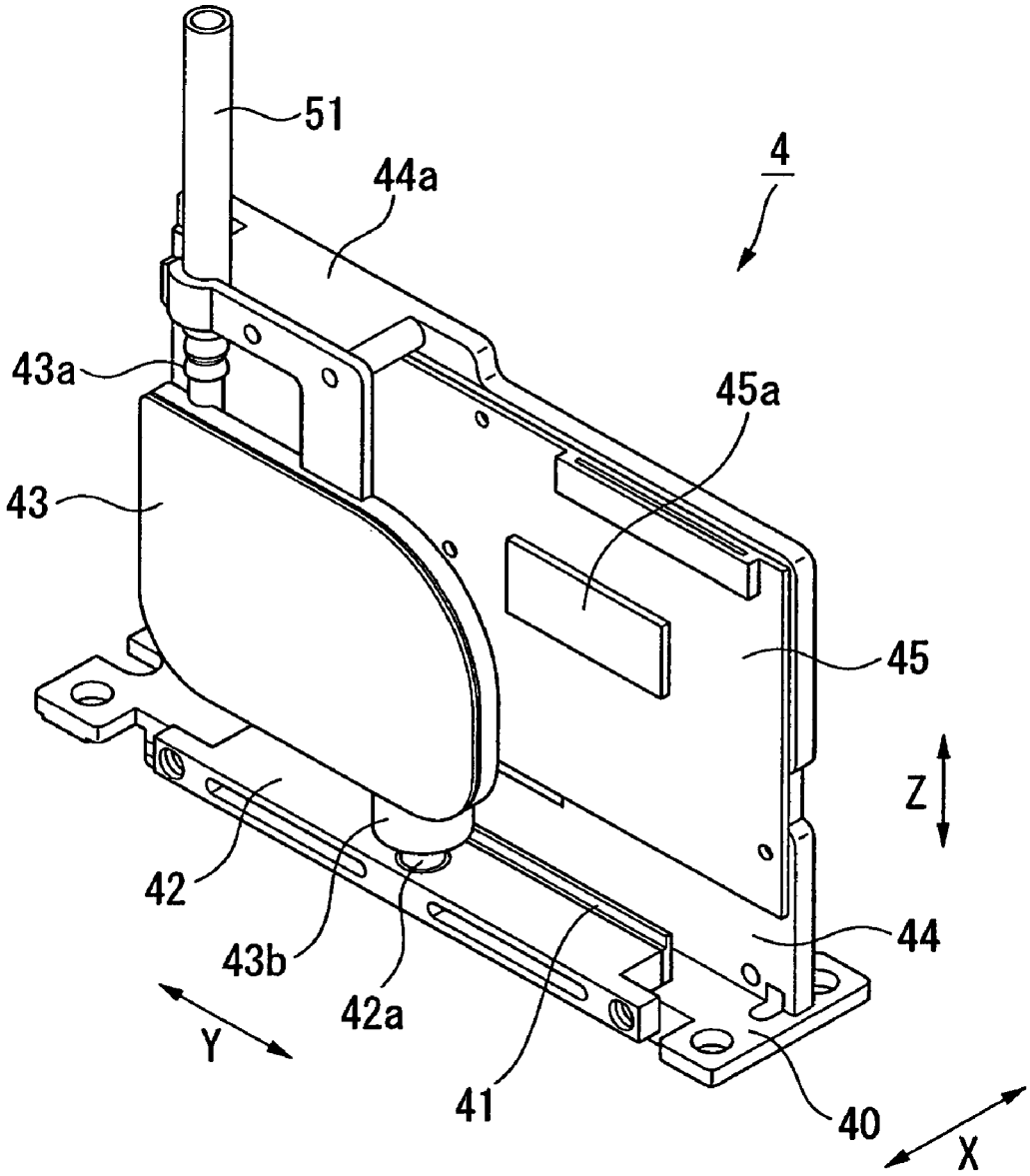
FIG. 2 is a perspective view for illustrating an inkjet head according to the embodiment of the present invention.
Figure 3:
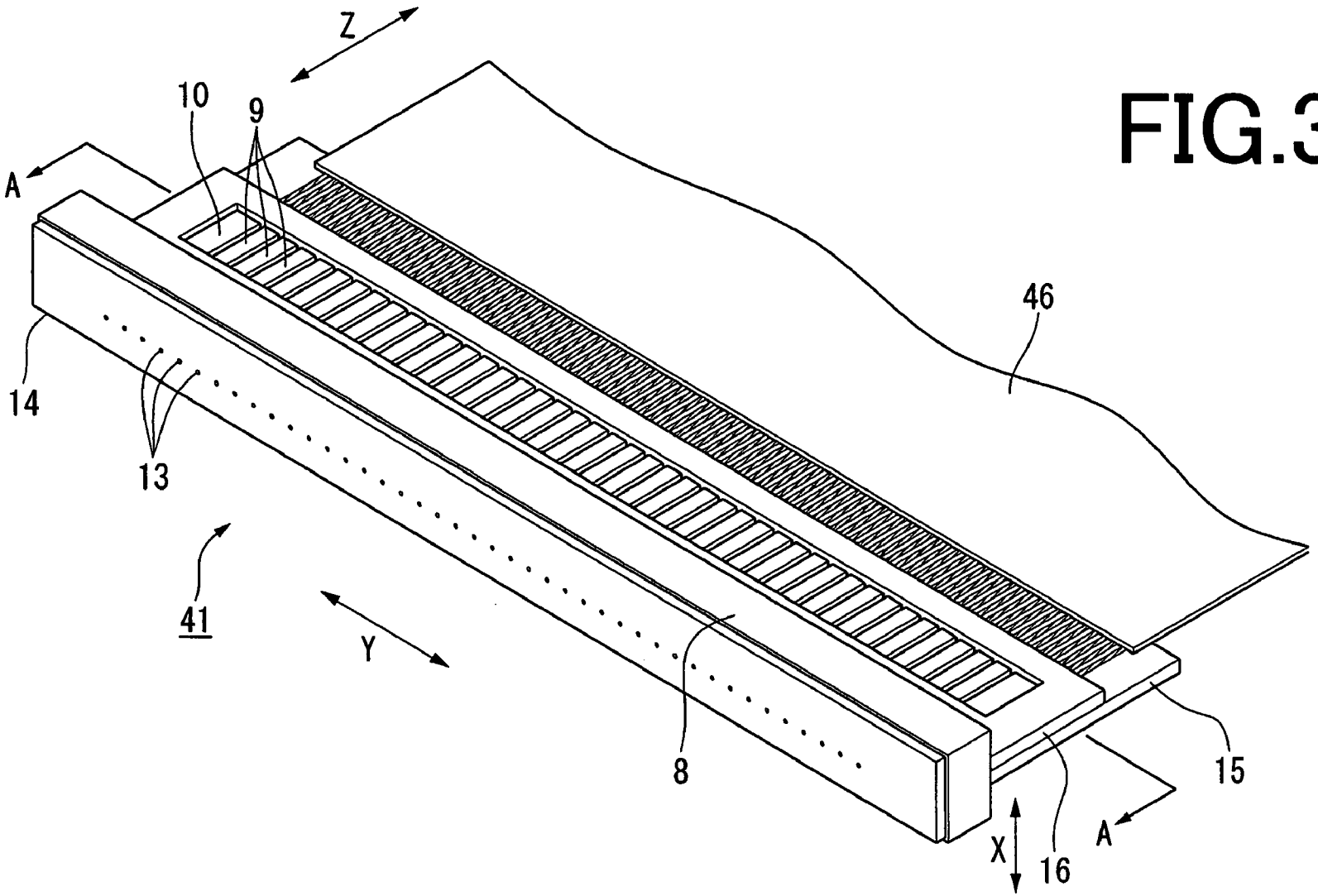
FIG. 3 is a perspective view for illustrating an inkjet head chip according to the embodiment of the present invention.
Figure 4:
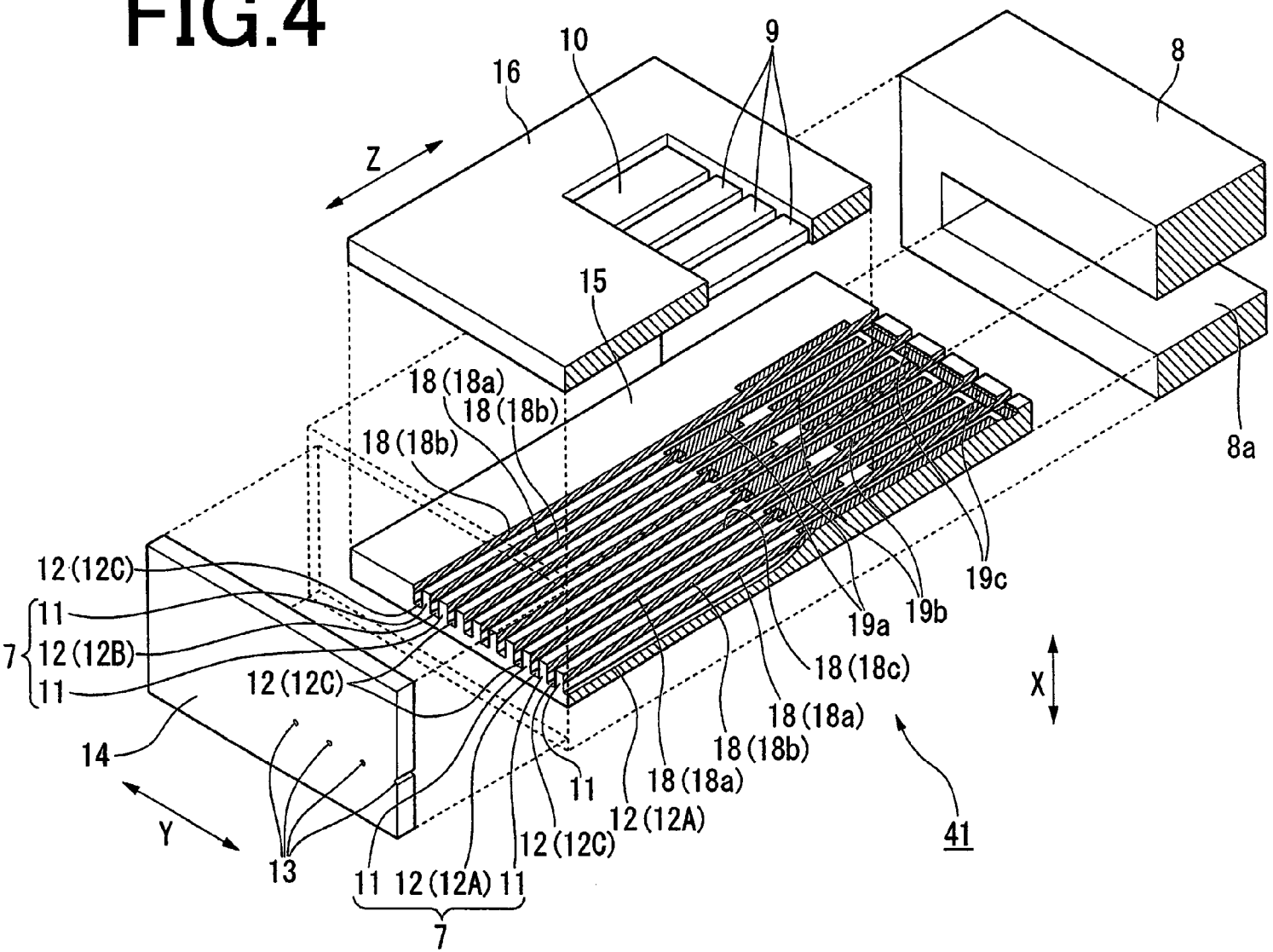
FIG. 4 is an exploded perspective view for illustrating the inkjet head chip according to the embodiment of the present invention.
Figure 5:
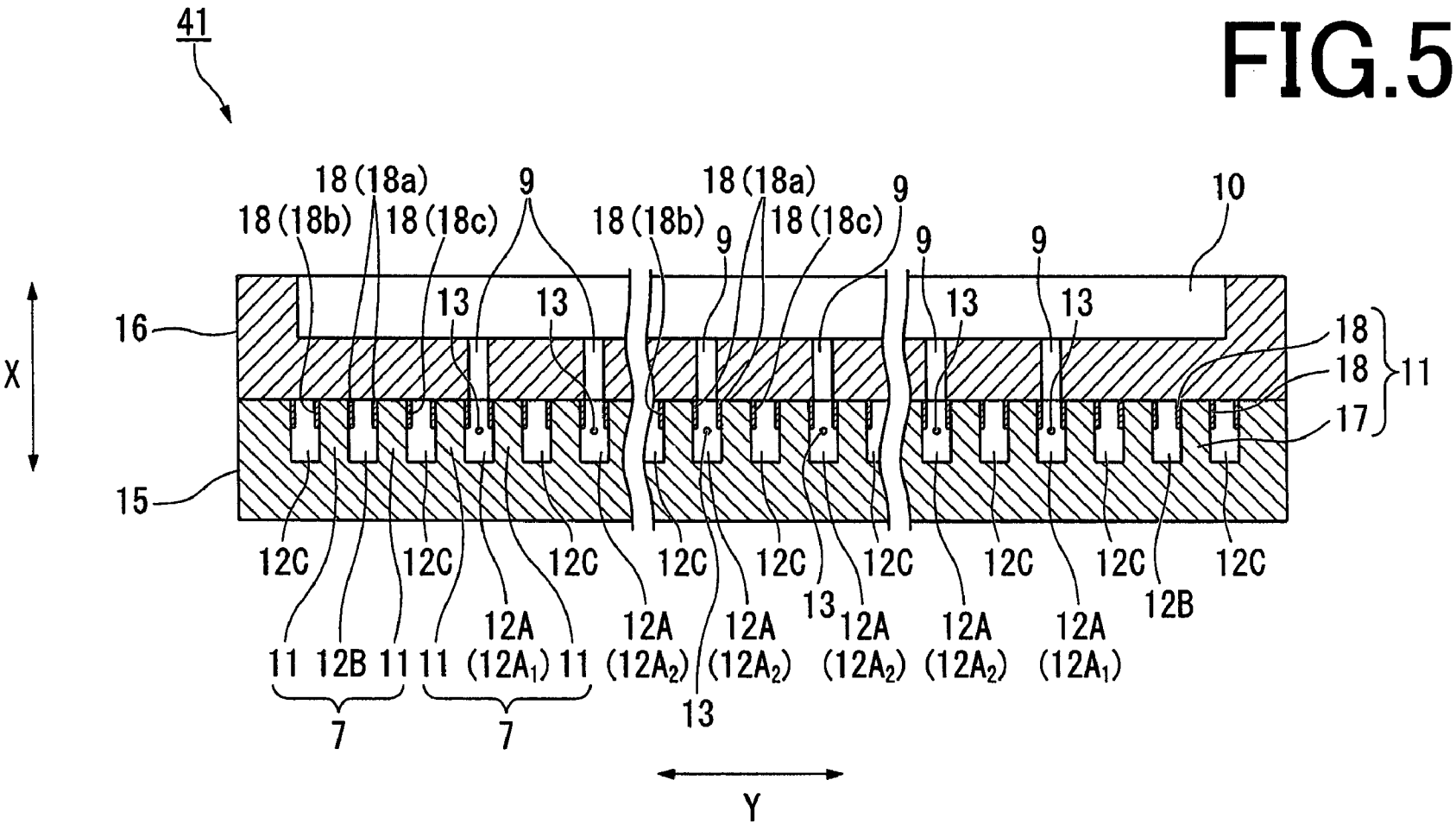
FIG. 5 is a cross-sectional view taken along an arrow A-A of FIG. 3.

FIG. 1 is a perspective view illustrating an example of the inkjet recording apparatus according to the present invention. FIG. 2 is a perspective view illustrating the inkjet head including the inkjet head chip according to the present invention. FIG. 3 is a perspective view illustrating an example of the inkjet head chip according to the present invention. FIG. 4 is an exploded perspective view of an inkjet head chip 41 illustrated in FIG. 3. FIG. 5 is a cross-sectional view taken along an arrow A-A of FIG. 3.

As illustrated in FIG. 1, an inkjet recording apparatus 1 includes a pair of transport means 2 and 3 for transporting a recording medium S such as paper, an inkjet head 4 for discharging ink onto the recording medium S, ink supply means 5 for supplying ink to the inkjet head 4, and scanning means 6 for causing the inkjet head 4 to scan in a direction (hereinafter, referred to as X direction) substantially orthogonal to a transport direction (hereinafter, referred to as Y direction) of the recording medium S.

The pair of transport means 2 and 3 include grid rollers 20 and 30 each extended in X direction, pinch rollers 21 and 31 each extended parallel to the grid rollers 20 and 30, and a drive mechanism (not shown) such as a motor which causes the grid rollers 20 and 30 to axially rotate, respectively.

The ink supply means 5 includes an ink tank 50 containing ink and an ink supply tube 51 for connecting the ink tank 50 with the inkjet head 4. A plurality of the ink tanks 50 are provided, and more specifically, ink tanks 50Y, 50M, 50C, and 50B for four kinds of ink of yellow, magenta, cyan, and black are arranged in Y direction. The ink supply tube 51 is formed of a flexible hose having flexibility, which is capable of responding to an operation of the inkjet head 4 (carriage 62).

The scanning means 6 includes a pair of guide rails 60 and 61 extended in X direction, the carriage 62 capable of sliding along the pair of guide rails 60 and 61, and a drive mechanism 63 which moves the carriage 62 in X direction. The drive mechanism 63 includes a pair of pulleys 64 and 65 disposed between the pair of guide rails 60 and 61, an endless belt 66 wound between the pair of pulleys 64 and 65, and a drive motor 67 which rotatably drives the pulley 64. The pair of pulleys 64 and 65 are disposed between both ends of the pair of guide rails 60 and 61, respectively, and are disposed with an interval in X direction. The endless belt 66 is disposed between the pair of guide rails 60 and 61, and the carriage 62 is coupled to the endless belt 66. The carriage 62 is equipped with a plurality of the inkjet heads 4, and specifically, inkjet heads 4Y, 4M, 4C, and 4B for four kinds of ink of yellow, magenta, cyan, and black are arranged in X direction.

As illustrated in FIG. 2, the inkjet head 4 includes amounting base 40, the inkjet head chip 41, a flow path substrate 42, a pressure adjustment unit 43, a base plate 44, and a wiring board 45. The mounting base 40 is fixed to a base 62*a* of the carriage 62 with a screw or the like, and the inkjet head chip 41 is mounted onto the mounting base 40. The flow path substrate 42 is mounted onto one surface of the inkjet head chip 41. A flow path (not shown) for distributing ink is formed inside the flow path substrate 42, and an inflow port 42*a* communicating with the flow path is formed on a top surface of the flow path substrate 42. The pressure adjustment unit 43 is used for absorbing pressure fluctuation of ink, and includes a reservoir (not shown) for reserving ink. The pressure adjustment unit 43 is fixed to a distal end of a support unit 44*a* mounted on a top end of the base plate 44 to protrude therefrom. An ink intake port 43*a* connected with the ink supply tube 51 is provided above the pressure adjustment unit 43, and an ink discharge port 43*b* connected with the inflow port 42*a* of the flow path substrate 42 is provided under the pressure adjustment unit 43. The base plate 44 is held upright relative to a top surface of the mounting base 40 so as to be substantially perpendicular thereto, and the wiring board 45 is mounted onto the surface of the base plate 44. The wiring board 45 includes a control circuit 45*a* which controls the inkjet head chip 41 formed therein.

As illustrated in FIG. 3 and FIG. 4, the inkjet head chip 41 includes an ink chamber 10 containing ink, piezoelectric elements 11 deformable by applying a voltage, a plurality of channels 12 partitioned with the piezoelectric elements 11 and formed parallel to each other, and nozzle holes 13 which discharge an ink droplet toward the recording medium S illustrated in FIG. 1.

More specifically, the inkjet head chip 41 is a so-called independent channel type inkjet head chip, and includes a nozzle plate 14 including the nozzle holes 13 formed therein, an actuator plate 15 in which the plurality of piezoelectric elements 11 are held upright relative thereto parallel to each other at intervals and the plurality of channels 12 are formed, an ink chamber plate 16 including the ink chamber 10 formed therein, and a nozzle cap 8 for supporting the nozzle plate 14.

The actuator plate 15 is a rectangular plate formed of, for example, a piezoelectric material such as lead zirconate titanate (PZT). On one surface of the actuator plate 15, the recessed-groove-like channels 12 which extend in a shorter side direction (hereinafter, referred to as Z direction) of the actuator plate 15 and have a rectangular shape in cross section are formed. The plurality of channels 12 are arranged at predetermined intervals in a longitudinal direction (Y direction) of the actuator plate 15.

As illustrated in FIG. 4 and FIG. 5, the above-mentioned channels 12 include discharge channels 12A (common channels) disposed in a middle portion of the channels 12 in a channel parallel direction (Y direction), dummy channels 12B disposed in both end portions thereof in the channel parallel direction (Y direction), and non-discharge channels 12C (active channels) each disposed between the adjacent discharge channels 12A and between the discharge channel 12A and the dummy channel 12B.

The discharge channel 12A is the channel 12 capable of discharging an ink droplet, and communicates with the nozzle hole 13 and with the ink chamber 10 via an ink introduction hole 9. On the other hand, the dummy channel 12B is the channel 12 incapable of discharging an ink droplet, and does not communicate with the ink chamber 10 nor the nozzle hole 13. In other words, the discharge of an ink droplet from the dummy channel 12B toward the recording medium S, and the supply of ink from the ink chamber 10 to the dummy channel 12B are interrupted.

Further, as illustrated in FIG. 4, distal ends of the discharge channel 12A and the dummy channel 12B (ends on a nozzle hole 13 side) are extended to an end surface of the actuator plate 15 while keeping the same depth. The distal ends of the discharge channel 12A and the dummy channel 12B are obstructed with the nozzle plate 14. Proximal ends of the discharge channel 12A and the dummy channel 12B (ends on a side opposite to the nozzle hole 13 side) have inclined bottom surfaces. The proximal ends of the discharge channel 12A and the dummy channel 12B are gradually reduced in depth as approaching proximal end sides thereof.

The non-discharge channel 12C is the channel 12 incapable of discharging an ink droplet and does not communicate with the ink chamber 10. Hence, supply of ink from the ink chamber 10 thereto is interrupted. As illustrated in FIG. 4, the non-discharge channel 12C is extended over the entire length of the actuator plate 15 while keeping the same depth, a distal end of the non-discharge channel 12C is blocked by the nozzle plate 14, and a proximal end thereof is open. The non-discharge channels 12C are arranged alternately with respect to the discharge channel 12A and the dummy channel 12B. Specifically, a pair of adjacent piezoelectric elements 11 and the discharge channel 12A or the dummy channel 12B formed therebetween constitute a unit 7. A plurality of the units 7 are arranged parallel to each other in Y direction via the non-discharge channels 12C arranged therebetween.

Of the plurality of channels 12, it is preferred to set the 1st to 5th ("1 to 5" are integers) channels 12 from the end channels 12 in a channel parallel direction (Y direction) as the dummy channels 12B.

The piezoelectric element 11 is formed between the adjacent channels 12. The piezoelectric element 11 includes a piezoelectric body 17 having a rectangular shape in cross section and drive electrodes 18 each provided on both side surfaces of the piezoelectric body 17. The piezoelectric body 17 is a side wall portion which is formed between the adjacent channels 12 so as to extend in Z direction, and is formed by forming a plurality of rectangular grooves (channels 12) parallel to each other at predetermined pitches on one surface of a plate formed of the piezoelectric material. The drive electrode 18 is a belt-like electrode extending in Z direction, and is deposited on a top of the side wall of the piezoelectric body 17.

The actuator plate 15 includes common extraction electrodes 19*a*, active extraction electrodes 19*b*, and connection electrodes 19*c*. The common extraction electrode 19*a* is disposed on one surface of the proximal end of the actuator plate 15 and is connected to a proximal end of a drive electrode 18*a* disposed on inner surfaces of the discharge channel 12A and the dummy channel 12B. The active extraction electrodes 19*b* are disposed parallel to each other at intervals with respect to the common extraction electrodes 19*a*, and are each connected to drive electrodes 18*b* disposed on ones of inner surfaces of the non-discharge channels 12C provided on both sides of the discharge channel 12A or the dummy channel 12B so as to interpose the discharge channel 12A and the dummy channel 12B therebetween. The connection electrode 19*c* is an electrode which connects a proximal end of the drive electrode 18*b* disposed in one of the inner surfaces of each of the non-discharge channels 12B provided on the both sides of the discharge channel 12A and the dummy channel 12B with a proximal end of a drive electrode 18*c* provided on another one of the inner surfaces thereof, and is disposed on proximal end sides of the common extraction electrode 19*a* and the active extraction electrode 19*b*.

Further, a flexible substrate 46 having flexibility, which is illustrated in FIG. 3, is interposed between the proximal end of the actuator plate 15 and the wiring board 45. An electrode pattern (not shown) is formed on the flexible substrate 46, and the extraction electrodes 19*a* and 19*b* are connected to the control circuit 45*a* of the wiring board 45 via the electrode pattern.

Note that the discharge channel 12A and the dummy channel 12B have a similar shape. Further, the piezoelectric elements 11 adjacent to both sides of the discharge channel 12A and the piezoelectric elements 11 adjacent to both sides of the dummy channel 12B have a similar structure, and a similar voltage is applied to the piezoelectric elements 11 adjacent to the discharge channel 12A and the piezoelectric elements 11 adjacent to the dummy channel 12B.

The ink chamber plate 16 is a rectangular plate superimposed on the actuator plate 15, and is disposed so as to block the channels 12. The recessed-groove-like ink chamber 10 having a rectangular shape in plan view, which extends in a longitudinal direction (Y direction) of the ink chamber plate 16, is formed on one surface (side opposite to the actuator plate 15 side) of the ink chamber plate 16. The rectangular ink introduction holes 9 penetrating the ink chamber plate 16 toward another surface (actuator plate 15 side) are formed on a bottom surface of the ink chamber 10. The ink chamber 10 communicates with the discharge channel 12A through the ink introduction hole 9. In other words, the ink introduction holes 9 are disposed above the discharge channels 12A. On the other hand, the ink introduction holes 9 are not formed above the dummy channel 12B and the non-discharge channels 12C.

Further, the flow path substrate 42 illustrated in FIG. 2 is bonded to and superimposed on one surface of the ink chamber plate 16, and the ink chamber 10 communicates with the flow path (not shown) of the flow path substrate 42.

The nozzle plate 14 is a rectangular plate bonded to an end surface on the channel distal end side of the actuator plate 15, and is disposed so as to block the distal end side of the channel 12. In the nozzle plate 14, the plurality of nozzle holes 13 are arranged in a row in the channel parallel direction (Y direction). Those nozzle holes 13 are disposed at distal end positions of the discharge channels 12A, and are not provided at distal end positions of the dummy channels 12B and the non-discharge channels 12C.

The nozzle cap 8 is a block body including an opening 8*a* formed therein, in which the actuator plate 15 and the ink chamber plate 16 are inserted therethrough, and is bonded to a back surface (surface opposite to a surface facing the recording medium S) of the nozzle plate 14.

Next, a description is given of operations of the inkjet recording apparatus 1 having the above-mentioned structure and the inkjet head chip 41.

First, ink contained in the ink tank 50 is supplied to the inkjet head 4 by the ink supply means 5. More specifically, the ink contained in the ink tank 50 flows toward the inkjet head 4 side through the ink supply tube 51, and flows into the pressure adjustment unit 43 from the ink intake port 43*a*. The ink stored in the pressure adjustment unit 43 flows from the ink discharge port 43*b*, flows into the flow path substrate 42 from the inflow port 42*a*, and is supplied into the ink chamber 10 of the inkjet head chip 41 through the flow path of the flow path substrate 42. The ink contained in the ink chamber 10 flows into the respective discharge channels 12A through the ink introduction holes 9. It should be noted that the ink introduction holes 9 are not formed at positions of the dummy channels 12B and the non-discharge channels 12C, and hence the ink contained in the ink chamber 10 does not flow into the dummy channels 12B and the non-discharge channels 12C, whereby the dummy channels 12B and the non-discharge channels 12C are empty.

Next, the recording medium S is transported in Y direction by the pair of transport means 2 and 3. More specifically, the grid roller 20 disposed on the upstream side is caused to axially rotate by the drive mechanism (not shown) in a state in which the recording medium S is sandwiched between the grid roller 20 and the pinch roller 21 which are disposed on the upstream side. Accordingly, the recording medium S passes under the inkjet head chip 41 (nozzle plate 14) to be transported in Y direction. The recording medium S which has passed under the inkjet head chip 41 is sandwiched between the grid roller 30 and the pinch roller 31 which are disposed on a downstream side. Then, the grid roller 30 disposed on the downstream side is caused to axially rotate by the drive mechanism (not shown), whereby the recording medium S is delivered.

On the other hand, while the recording medium S passes under the inkjet head 4 (inkjet head chip 41) as described above, the inkjet head 4 is caused to scan in X direction by the scanning means 6. More specifically, first, the drive motor 67 of the drive mechanism 63 is driven, to thereby rotatably drive the pulley 64 of the pair. As a result, the endless belt 66 is circulated and moved between the pair of pulleys 64 and 65, and the carriage 62 fixed to the endless belt 66 is moved in X direction, with the result that the plurality of inkjet heads 4 mounted onto the carriage 62 are caused to scan in X direction.

Further, the inkjet head 4 sprays an ink droplet onto the recording medium S while performing the above-mentioned scanning operation by the inkjet head 4. More specifically, a drive signal is sent to the control circuit 45*a* of the wiring board 45, and a voltage is applied to the drive electrodes 18 of the piezoelectric element 11 adjacent to the discharge channel 12A and the drive electrodes 18 of the piezoelectric element 11 adjacent to the dummy channel 12B from the control circuit 45*a* through the electrode pattern (not shown) of the flexible substrate 46, the common extraction electrode 19*a*, the active extraction electrode 19*b*, and the connection electrode 19*c*. As a result, the piezoelectric elements 11 disposed on both sides of the dummy channel 12B are deformed into a curved shape so as to expand toward the dummy channel 12B. When the piezoelectric elements 11 disposed on both sides of the discharge channel 12A are deformed as described above, a volume of the discharge channel 12A is contracted, and hence the ink contained in the discharge channel 12A is discharged from the nozzle hole 13.

In this case, on both sides of each discharge channel $\mathbf{12}A_2$ formed in the middle portion of a plurality of the discharge channels 12A, other discharge channels $\mathbf{12}A_2$ are formed. The discharge channel $\mathbf{12}A_2$ is affected, from the both sides thereof, by an electric field applied to other channels 12 (discharge channels $\mathbf{12}A_2$). Further, on one side of a discharge channel $\mathbf{12}A_1$ in each of the both end portions thereof, another discharge channel $\mathbf{12}A_2$ is formed (center side in the channel parallel direction), and on another side thereof, a dummy channel 12B is formed. The discharge channel $\mathbf{12}A_1$ is affected, from both sides thereof, by an electric field applied to other channels 12 (discharge channel $\mathbf{12}A_2$ and dummy channel 12B). Specifically, of the plurality of discharge channels 12A, an electrical condition of the discharge channels $\mathbf{12}A_1$ in the both end portions and that of the discharge channels $\mathbf{12}A_2$ in the middle portion become similar to each other.

Further, the supply of the ink from the ink chamber 10 to the dummy channel 12B is interrupted. Hence, even when the piezoelectric elements 11 on the both sides of the dummy channel 12B deform into a curved shape so as to expand toward inside of the dummy channel 12B side as described above, the ink droplet is not discharged from the dummy channel 12B.

According to the inkjet head chip 41, the driving method for the inkjet head chip 41, and the inkjet recording apparatus 1 having the above-mentioned structure, of the plurality of discharge channels 12A, the electrical condition of the discharge channels $\mathbf{12}A_1$ in the both end portions of the plurality of discharge channels 12A becomes similar to the electrical condition of the discharge channels $\mathbf{12}A_2$ in the middle portion thereof. As a result, the difference in ink discharge speed is hardly caused between the middle portion and the both end portions thereof in the channel parallel direction, whereby a uniform ink discharge speed from each nozzle hole 13 can be achieved. Accordingly, the image quality of printing can be improved.

In particular, in the above-mentioned inkjet head chip 41, a similar voltage is applied to the piezoelectric elements 11 on the both sides of the discharge channel 12A and to the piezoelectric elements 11 on the both sides of the dummy channel 12B, whereby the electrical condition of the discharge channels $\mathbf{12}A_1$ in the both end portions of the plurality of channels 12 and that of the discharge channels $\mathbf{12}A_2$ in the middle portion thereof become similar to each other. Accordingly, the ink discharge speed can be made substantially equal to each other between the middle portion in the channel parallel direction and the both end portions in the channel parallel direction.

Further, according to the inkjet head chip 41 having the structure described above, of the plurality of channels 12, the 1st to 5th channels 12 from the end channels 12 in the channel parallel direction are set as the dummy channels 12B, whereby an increase in the number of channels can be suppressed while a uniform ink discharge speed is achieved. Accordingly, the increase in size of the inkjet head chip 41 can be suppressed.

The inkjet head chip, the driving method for an inkjet head chip, the inkjet head, and the inkjet recording apparatus according to the embodiment of the present invention have been described above, but the present invention is not limited to the embodiment described above and can be appropriately changed without departing from the gist thereof.

For example, in the above-mentioned embodiment of the present invention, the nozzle hole 13 is disposed in the end in the channel existing direction. However, the present invention may employ a structure in which the nozzle hole 13 is formed in the bottom surface of the channel 12.

Further, in the above-mentioned embodiment of the present invention, the description has been made on the independent channel type inkjet head chip 41 in which the discharge channels 12A and the non-discharge channels 12C are alternately arranged. However, the present invention may be a shared wall type inkjet head chip in which the discharge channels 12A are successively arranged.

Further, in the above-mentioned embodiment of the present invention, there has been described the structure in which the ink introduction hole 9 is not formed in the position of the dummy channel 12B and therefore the supply of the ink from the ink chamber 10 to the dummy channel 12B is interrupted. However, even when a structure in which the ink is supplied from the ink chamber 10 to the dummy channel 12B is employed, the present invention may be conducted as long as the discharge of the ink droplet from the dummy channel 12B is interrupted. More specifically, the ink introduction hole 9 may be formed in the position of the dummy channel 12B as long as the nozzle hole 13 is not formed in the position of the dummy channel 12B.

Further, in the above-mentioned embodiment of the present invention, a similar voltage is applied to the piezoelectric elements 11 adjacent to the discharge channel 12A and the piezoelectric elements 11 adjacent to the dummy channel 12B. However, in the present invention, different voltages may be applied to the piezoelectric elements 11 adjacent to the discharge channel 12A and the piezoelectric elements 11 adjacent to the dummy channel 12B. For example, printing performed on the recording medium S is inspected with a sensor or the like and the difference in ink discharge speed is detected to calculate a correction value according to the difference, whereby the voltage to be applied to the piezoelectric elements 11 adjacent to the dummy channel 12B can be adjusted.

Further, in the above-mentioned embodiment of the present invention, the dummy channel 12B is provided on each of the both end portions of the plurality of channels 12. However, in the present invention, the number of dummy channels 12B can be appropriately changed, and can be set according to the difference in ink discharge speed.

Moreover, without departing from the gist of the present invention, the constitutional elements of the above-mentioned embodiment can be appropriately replaced by well-known constitutional elements, and the above-mentioned modifications may be appropriately combined with each other.

What is claimed is:

1. An inkjet head chip, comprising:

an ink chamber for containing ink;

a plurality of piezoelectric elements deformable by applying a voltage;

a plurality of channels partitioned with the plurality of piezoelectric elements and disposed parallel to each other along a width direction of the inkjet head chip; and a nozzle hole for discharging an ink droplet toward a recording medium;

wherein the plurality of channels comprise a discharge channel disposed in a middle portion of the parallely disposed plurality of channels, dummy channels disposed outside of the discharge channel at respective ends thereof, and non-discharge channels disposed outside of the respective dummy channels;

wherein the discharge channel communicates with the ink chamber via an ink introduction hole and with the nozzle hole;

wherein at least one of discharge of the ink droplet from the dummy channels toward the recording medium and supply of the ink from the ink chamber to the dummy channels is interrupted;

wherein the discharge of an ink droplet from the non-discharge channels toward the recording medium and the supply of ink from the ink chamber to the non-discharge channels are interrupted; and wherein the inkjet head chip is configured such that voltages are substantially simultaneously applied to one of the plurality of piezoelectric elements which is adjacent to the discharge channel and to one of the plurality of piezoelectric elements which is disposed between the dummy and non-discharge channels.

2. An inkjet head chip according to claim 1; wherein the inkjet head chip is configured such that substantially the same voltage is applied to the one of the plurality of piezoelectric elements which is adjacent to the dummy channel and to the one of the plurality of piezoelectric elements which is adjacent to the discharge channel.

3. An inkjet head chip according to claim 2;

wherein, of the parallely disposed plurality of channels, each of 1st to 5th channels inside of each of the non-discharge channels is a dummy channel.

4. An inkjet head comprising the inkjet head chip according to claim 2.

5. An inkjet recording apparatus, comprising:

the inkjet head according to claim 4;

ink supply means for supplying ink to the ink chamber of the inkjet head chip; and recording medium transport means for transporting a recording medium so as to pass through a position opposed to the nozzle hole of the inkjet head chip.

6. An inkjet head chip according to claim 1; wherein, of the parallely disposed plurality of channels, each of 1st to 5th channels inside of each of the non-discharge channels is a dummy channel.

7. An inkjet head comprising the inkjet head chip according to claim 6.

8. An inkjet recording apparatus, comprising:

the inkjet head according to claim 7;

ink supply means for supplying ink to the ink chamber of the inkjet head chip; and recording medium transport means for transporting a recording medium so as to pass through a position opposed to the nozzle hole of the inkjet head chip.

9. An inkjet head comprising the inkjet head chip according to claim 1.

10. An inkjet recording apparatus, comprising:

the inkjet head according to claim 9;

ink supply means for supplying ink to the ink chamber of the inkjet head chip; and recording medium transport means for transporting a recording medium so as to pass through a position opposed to the nozzle hole of the inkjet head chip.

11. A driving method for an inkjet head chip, the inkjet head chip comprising:

an ink chamber for containing ink;

a plurality of piezoelectric elements deformable by applying a voltage;

a plurality of channels partitioned with the plurality of piezoelectric elements and disposed parallel to each other along a width direction of the inkjet head chip; and a nozzle hole for discharging an ink droplet toward a recording medium;

wherein the plurality of channels comprise a discharge channel disposed in a middle portion of the parallely disposed plurality of channels, dummy channels disposed outside of the discharge channel at respective ends thereof, and non-discharge channels disposed outside of the respective dummy channels;

wherein the discharge channel communicates with the ink chamber via an ink introduction hole and with the nozzle hole;

wherein at least one of discharge of the ink droplet from the dummy channels toward the recording medium and supply of the ink from the ink chamber to the dummy channels is interrupted; and wherein the discharge of an ink droplet from the non-discharge channels toward the recording medium and the supply of ink from the ink chamber to the non-discharge channels are interrupted;

the driving method comprising applying, substantially simultaneously, a voltage to one of the plurality of piezoelectric elements which is adjacent to the discharge channel and a voltage to one of the plurality of piezoelectric elements which is disposed between the dummy channel and the non-discharge channel.

12. An inkjet head chip comprising:

an ink chamber plate having an ink chamber for containing ink;

an actuator plate having a plurality of channels disposed parallel to each other along a width direction of the actuator plate, the plurality of channels comprising a plurality of discharge channels each communicating with the ink chamber and configured for discharging an ink droplet, a pair of dummy channels formed at opposite end portions of the actuator plate and configured so that the dummy channels do not communicate with the ink chamber and are incapable of discharging ink droplets, and a plurality of non-discharge channels arranged alternately with respect to the discharge and dummy channels and configured so that the non-discharge channels do not communicate with the ink chamber and are incapable of discharging ink droplets; and a plurality of piezoelectric elements disposed in the plurality of channels and driven by a voltage signal for undergoing deformation to vary a volume in the channels to thereby eject ink droplets from the discharge channels, the plurality of channels and piezoelectric elements being configured so that when the piezoelectric elements are driven by the voltage signal, voltages are substantially simultaneously applied to the piezoelectric elements disposed in the discharge channels and to the piezoelectric elements disposed in the dummy and non-discharge channels.

13. An inkjet head chip according to claim 12; further comprising a nozzle plate connected to an end surface of the actuator plate, the nozzle plate having a plurality of nozzle openings each disposed in communication only with respective ones of the discharge channels so that when the piezoelectric elements are driven by a voltage signal ink droplets are ejected from the discharge channels through the nozzle openings.

14. An inkjet head comprising the inkjet head chip according to claim 13.

15. An inkjet recording apparatus, comprising:

the inkjet head according to claim 14;

ink supply means for supplying ink to the ink chamber of the inkjet head chip; and recording medium transport means for transporting a recording medium so as to pass through a position opposed to the nozzle openings of the nozzle plate so that during ejection from the nozzle openings, the ink droplets are discharged toward the recording medium.

16. An inkjet head chip according to claim 12; wherein the ink chamber plate has a plurality of introduction holes via which the respective discharge channels communicate with the ink chamber so that ink from the ink chamber flows to the discharge channels; and wherein the dummy and non-discharge channels do not communicate with the ink chamber so that ink contained in the ink chamber does not flow into the dummy and non-discharge channels.

17. An inkjet head comprising the inkjet head chip according to claim 12.

* * * * *